US006942108B2

(12) United States Patent
Wons et al.

(10) Patent No.: US 6,942,108 B2
(45) Date of Patent: Sep. 13, 2005

(54) DISPLAY RACK

(75) Inventors: Henrich Wons, Lakeland, FL (US); Michael Riley, Port Orange, FL (US)

(73) Assignee: Anderson News Company, Knoxville, TN (US)

( * ) Notice: Subject to any disclaimer, the term of this patent is extended or adjusted under 35 U.S.C. 154(b) by 0 days.

(21) Appl. No.: 10/250,246

(22) Filed: Jun. 17, 2003

(65) Prior Publication Data

US 2004/0074855 A1 Apr. 22, 2004

Related U.S. Application Data

(60) Provisional application No. 60/389,836, filed on Jun. 19, 2002.

(51) Int. Cl.[7] ..... B42F 1/00

(52) U.S. Cl. ..... 211/55; 211/128.1; 211/87.01

(58) Field of Search ..... 211/87.01, 72, 211/130.1, 133.3, 126.6, 126.1, 126.16, 55, 128.1, 94.01, 52, 56, 129.1; 248/154, 152, 174, 300

(56) References Cited

U.S. PATENT DOCUMENTS 1,927,171 A * 9/1933 Horwath ..... 211/72
2,292,932 A * 8/1942 Edwards ..... 211/128.1
4,162,014 A * 7/1979 Bobrick ..... 211/50
4,164,287 A * 8/1979 Muller et al. ..... 211/134
4,228,904 A * 10/1980 Dumond ..... 211/55
4,613,047 A * 9/1986 Bushyhead et al. ..... 211/55
4,905,845 A * 3/1990 Broeker et al. ..... 211/55
4,949,849 A * 8/1990 Hardy ..... 211/55
5,009,335 A * 4/1991 Jonker ..... 211/55
5,289,926 A * 3/1994 Lewis et al. ..... 211/45
5,758,781 A * 6/1998 Lord et al. ..... 211/55
5,915,571 A * 6/1999 Czalkiewicz et al. ..... 211/55
5,938,048 A * 8/1999 Carroll et al. ..... 211/55
6,116,433 A * 9/2000 Pursall ..... 211/55
6,422,403 B1 * 7/2002 Woolnough et al. ..... 211/55
6,439,399 B1 * 8/2002 Wegstein et al. ..... 211/55
6,530,485 B1 * 3/2003 Weber ..... 211/55
2001/0025823 A1 * 10/2001 Brozak ..... 211/55
2002/0162810 A1 * 11/2002 Wegstein et al. ..... 211/55

* cited by examiner

*Primary Examiner*—Carl D. Friedman
*Assistant Examiner*—Jennifer E. Novosad
(74) *Attorney, Agent, or Firm*—Blackwell Sanders Peper Martin LLP

(57) ABSTRACT

A display rack for articles comprising a plurality of elongate channels having a generally J-shaped cross-section defining a high rear wall, a low front wall, and a bottom surface to form a trough for supporting articles therein. Each of the elongate channels further have a front surface and a rear surface. Two weight transfer segments are removably attached to the rear surface of the elongate channels such that, when articles on displayed on the rack, the weight of the articles is distributed uniformly among the weight transfer segments.

6 Claims, 6 Drawing Sheets

DISPLAY RACK

CROSS REFERENCE TO RELATED APPLICATIONS

This application claims benefit of the filing date of U.S. Provisional Application No. 60/389,836, filed Jun. 19, 2002.

BACKGROUND OF INVENTION

The present invention relates generally to display racks for use in retail outlets, libraries, hotels, banks and the like. More specifically, the present invention relates to a display rack intended to be used for reading materials and the like and adapted for easy adjustability wherein the weight of any articles displayed on the rack is distributed evenly across the weight transfer segments of the rack.

Various display racks are known in the art. These devices are commonly used to display products such as books, magazine, video cassettes, greeting cards, and compact discs and the like at the retail level. A merchant wishing to display such items to customers generally purchases a display rack that can be utilized with the merchant's existing shelving, choosing one of the appropriate size and shape to fit the space available and also maximize the amount of available space usable for displaying products and offering them for sale.

There are a number of disadvantages to the known display rack devices. Since the display racks are generally used with a merchant's existing shelving, they must be attached thereto by some sort of attachment mechanism, often a hook or similar device. Once the display rack is attached, the weight of the rack and any articles displayed there is transferred to the existing shelving. If the articles displayed on the rack are not centered the weight may be distributed unevenly, causing damage to the existing shelving. This is a common problem because as customers browse through a merchant's products the generally fail to return a product to the precise location on the display from which it was taken. Further, a customers purchase items from the display rack, the number and position of items left on the rack becomes uneven and unpredictable. Thus, there is a need in the art for a display rack that is attachable to conventional fixed shelving but which distributes the weight of items displayed thereon evenly, even if the items are not spaced evenly across the display rack.

In addition, known display racks are often constructed of material such as wood which may vary in texture and color from rack to rack. This can be problematic for large retailers with multiple retail outlets because these retailers wish to maintain uniformity at each of their locations. Thus it is also desirable to provide a display rack with the weight distribution characteristics described above and which also maintains a uniform appearance from rack to rack such that retailers are able to maintain uniformity in their displays.

SUMMARY OF INVENTION

The present invention is a display rack for displaying articles such as books, magazine, pamphlets and the like thereon. The display rack has a plurality of elongate channels having generally J-shaped cross-sections, each having front and rear walls and a bottom surface forming a trough for supporting various articles therein. The elongate channels are attached to first and second weight transfer segments. Because of this arrangement, the weight of any articles displayed on the display rack is distributed evenly among the weight transfer segments. This provides a particularly stable structure for the display of such articles.

The weight transfer segments also have attachment portions adapted for attaching the display rack to a conventional fixed mounting structure. In a preferred embodiment of the present invention, the weight transfer segments have L-shaped tiers for receiving the channels.

Also in a preferred embodiment of the present invention, the display rack is constructed of acrylic material.

DETAILED DESCRIPTION

Figure 1:
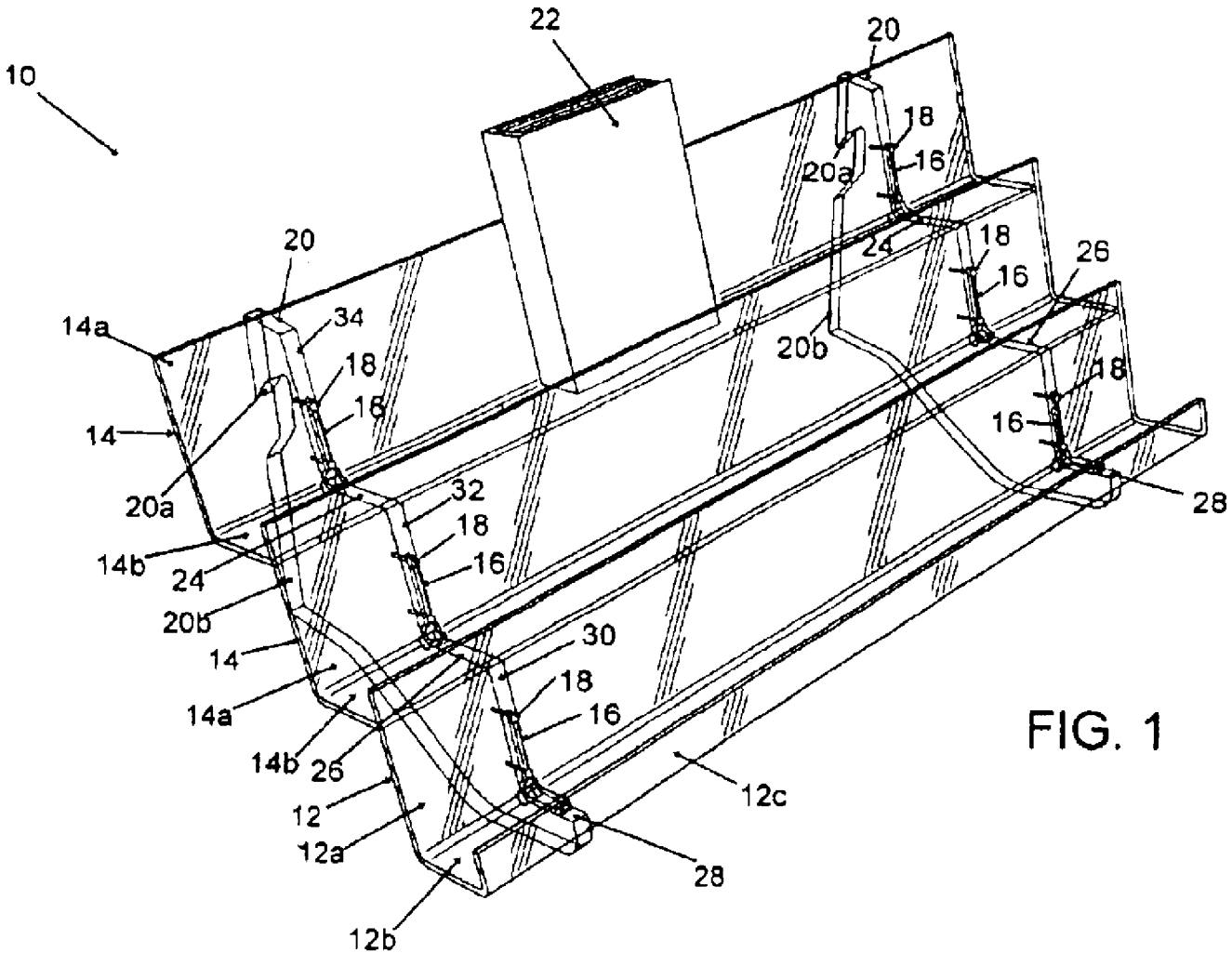
FIG. 1 is a front perspective view of the present invention showing a book supported thereon.

Referring now to the drawings wherein like numerals designate like parts, numeral 10 designates generally a display rack device constructed in accordance with the teachings of the present invention.

The entirety of display rack 10 is best shown in FIG. 1. As shown, display rack 10 has a plurality of elongate channels 12 and 14 spaced in vertical arrangement. In the embodiment shown in FIG. 1, the foremost elongate channel 12 has a generally J-shaped cross-section while each of the other elongate channels 14 have generally L-shaped cross-sections with the rear wall of each of elongate channels 14 except for the rearmost forming a low front wall of each elongate channel 14 immediately behind it. The low front wall of the foremost of elongate channels 14 is formed by the high rear wall of elongate channel 12. Low front wall 12*c* of elongate channel 12 is formed because of the J-shaped cross-section of elongate channel 12. Elongate channel 12 further includes a high rear wall 12*a*, a bottom surface 12*b*, a rear surface 11, and a front surface 13, thereby forming a trough in each elongate channel. Elongate channel 14 further includes a high rear wall 14*a*, a bottom surface 14*b*, a rear surface 15, and a front surface 17. It is understood that the present display rack 10 could be constructed with each of the elongate channels having a generally J-shaped cross-section such as that of elongate channel 12, or with each of the elongate channels having a generally L-shaped cross-section such as that of elongate channel 14.

Figure 2:
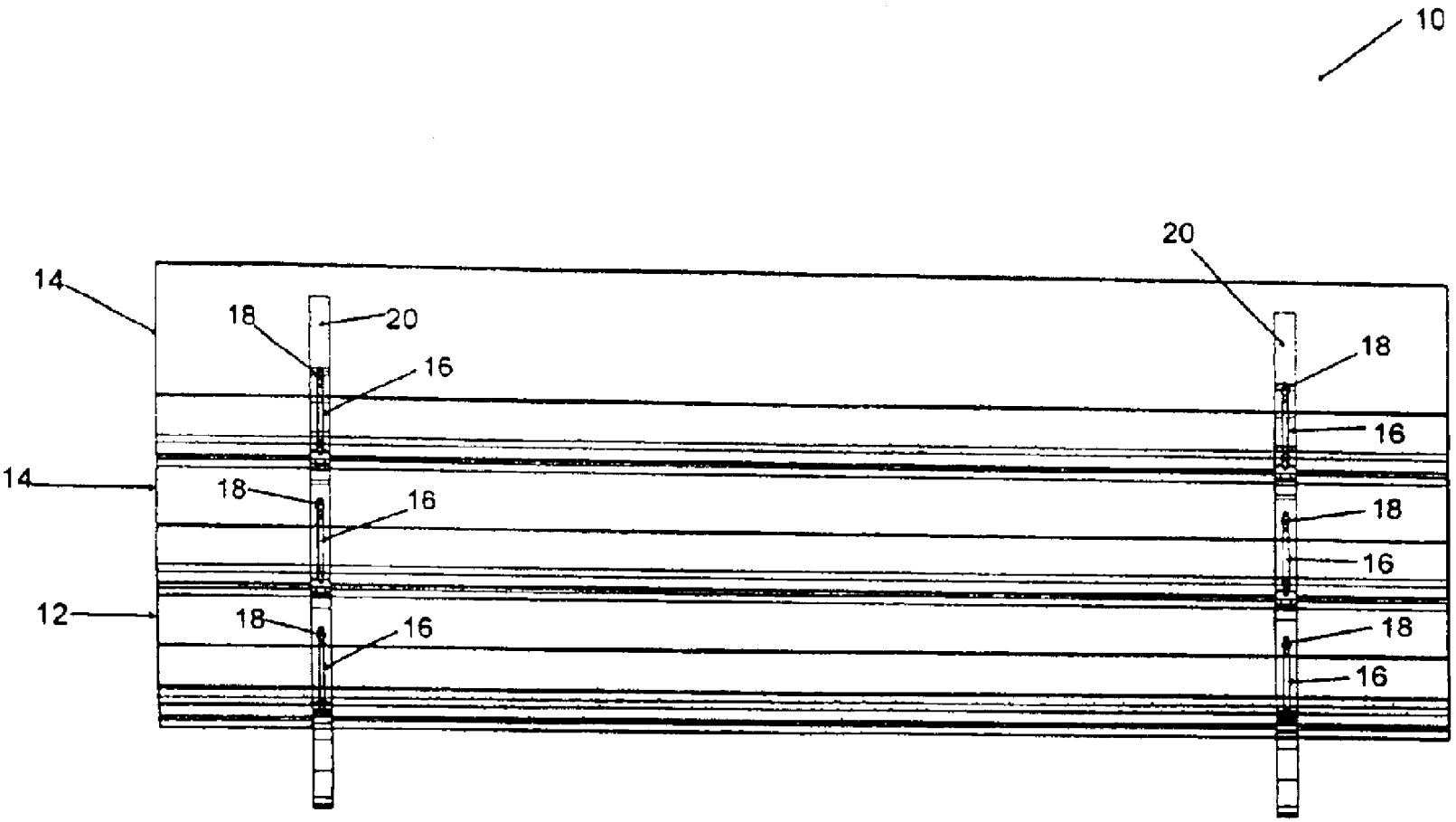
FIG. 2 illustrates a front elevational view of the present invention.

Referring now to FIG. 2, there is shown a front elevational view of the display rack of FIG. 1. This embodiment of the display rack has three elongate channels 12 and 14, with the foremost of these being an elongate channel 12 and the others being elongate channels 14. FIG. 2 illustrated the attachment of elongate channels 12 and 14 to weight transfer segment 20, as explained further below.

Figure 4:
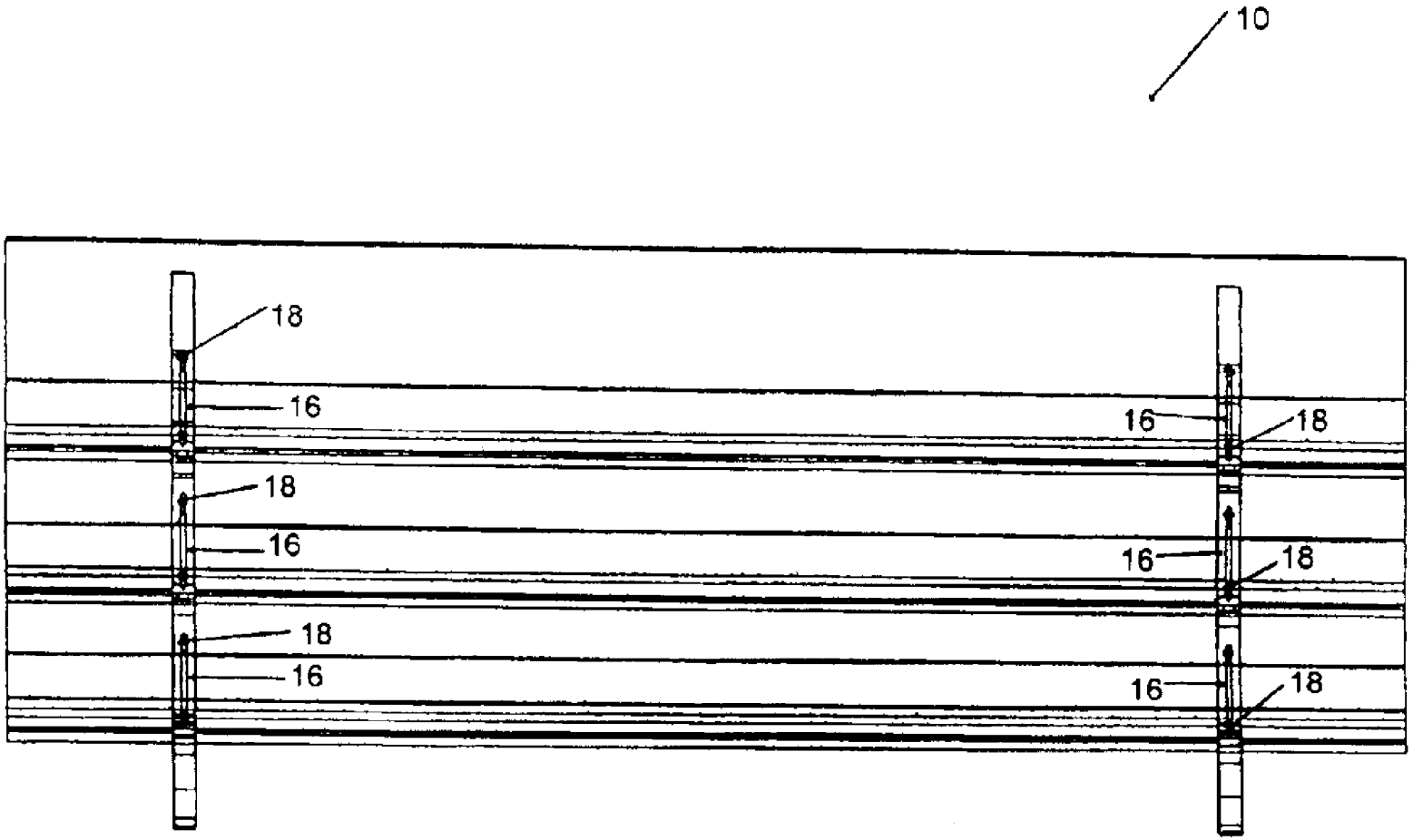
FIG. 4 illustrates a rear elevational view of the present invention.
Figure 5:
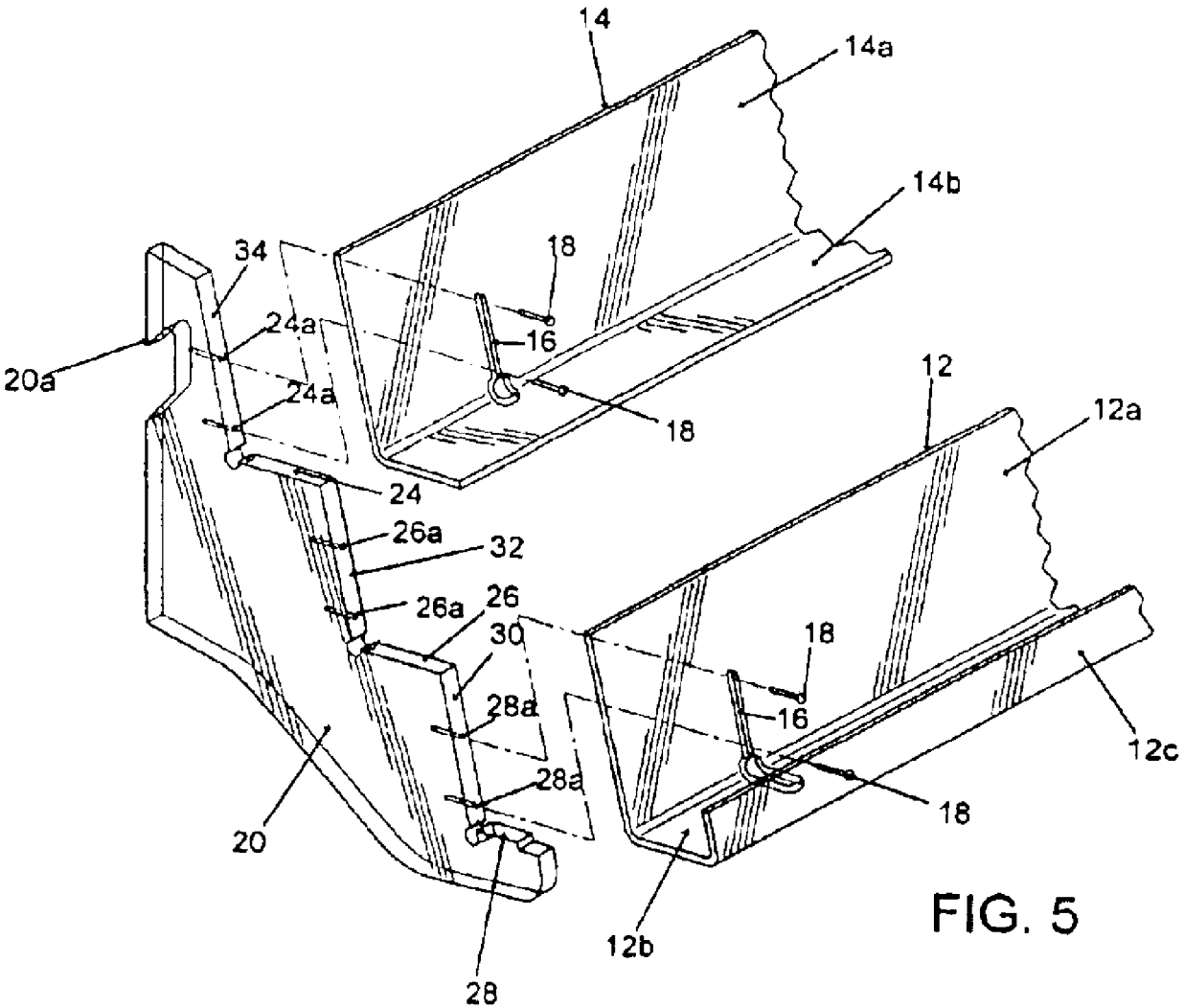
FIG. 5 illustrates an exploded end perspective view of the present invention.

Each of elongate channels 12 and 14 has two vertical slits 16 cut therein, as best shown in FIGS. 2, 4 and 5. Slits 16 are adapted such that fasteners 18 may extend therethrough and thereby attach elongate channels 12 and 14 to weight transfer segments 20. Thus, when articles such as book 22 are placed within the troughs of elongate channels 12 and 14, the weight of the articles is distributed evenly among weight transfer segments 20.

Weight transfer segments 20 are preferably constructed of a unitary piece of acrylic material or other suitable, preferably transparent material. Each weight transfer segment 20 preferably has a plurality of L-shaped cutouts for supporting the attachment of elongate channels 12 and 14 thereupon. As best shown in FIG. 5, the L-shaped cutouts are disposed in a tier arrangement such that each elongate channel 12 or 14 is higher and rearward relative to the one preceding it. A preferred embodiment 10 of the present invention utilizes a three-tiered arrangement for the placement of three elongate channels 12 and 14. The foremost, lowermost L-shaped tier forms a bottom surface 28, a rear wall surface 30, and a plurality of openings 28*a* in rear wall surface 30 adapted for receipt of fasteners 18 therein. The middle tier forms a bottom surface 26, a rear wall surface 32, and a plurality of openings 26*a* in rear wall surface 32 adapted for receipt of fasteners 18 therein. The rearmost, highest tier forms a bottom surface 24, a rear wall surface 34, and a plurality of openings 24*a* in rear wall surface 34 adapted for receipt of fasteners 18 therein. Weight transfer segments 20 each further include an attachment portion 20*a* for attaching display rack 10 to a conventional gondola or fixed mounting structure (not shown).

Figure 3:
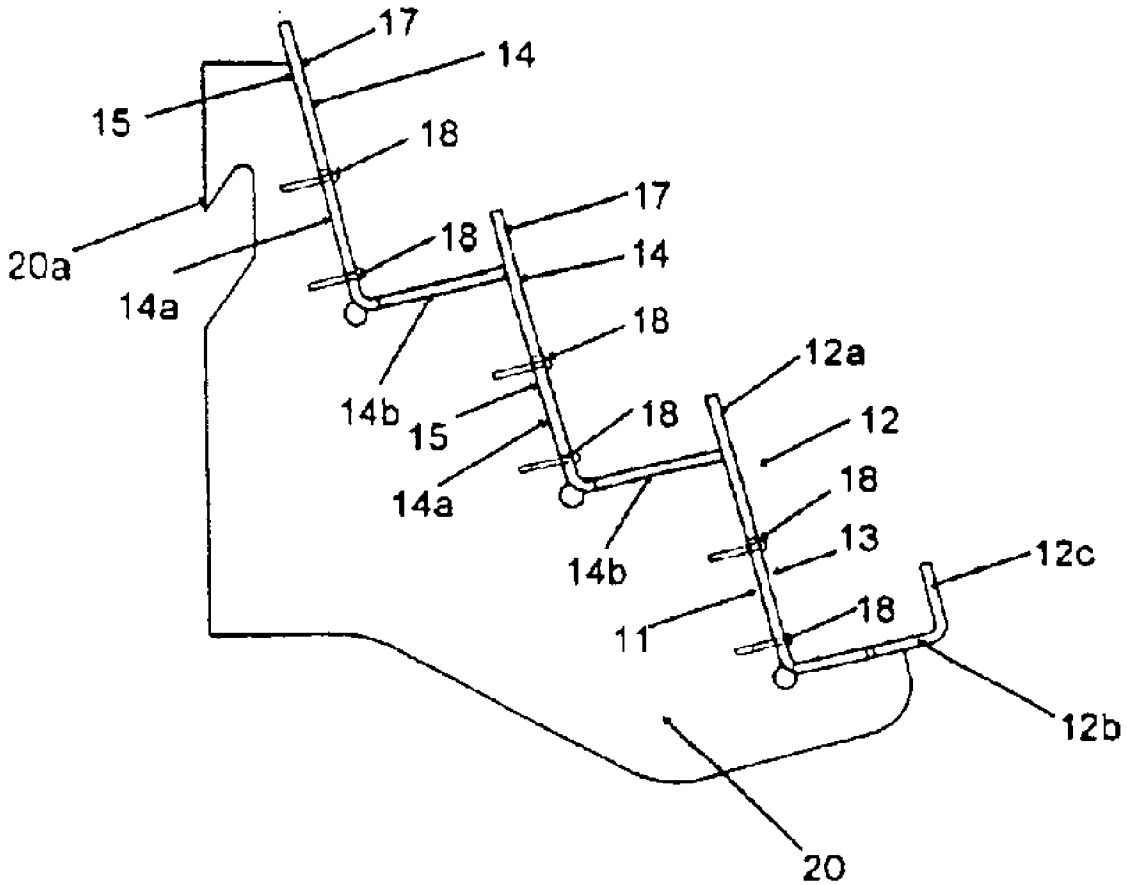
FIG. 3 illustrates an end elevational view of the present invention.

The display rack of the present invention is assembled as follows (best shown in FIG. 5). Elongate channels 12 and 14 are mounted on weight transfer segment 20 such that slits 16 are aligned with openings 24*a*, 26*a*, and 28*a*. Fasteners 18 are inserted through slits 16 and into openings 24*a*, 26*a* and 28*a*, thereby attaching elongate channels 12 and 14 to weight transfer segment 20. Fasteners 18 may be screws or any other fastener suitable for attaching elongate channels 12 and 14 to weight transfer segment 20. As shown in FIG. 3, once attached, elongate channels 12 and 14 are flush against the bottom and rear wall surfaces of L-shaped tiers 24, 26 and 28, and are tilted at a slight upward angle such that retention of any articles displayed on display rack 10 is accomplished by gravity. A preferred embodiment of the present invention 10 utilizes two weight transfer segments 20 for supporting elongate channels 12 and 14. In such an embodiment, the attachment of the second weight transfer segment 20 is substantially identical to the attachment of the first weight transfer segment 20. This arrangement allows the weight of any articles displayed on display rack 10 to be distributed equally among the two weight transfer segments 20, thereby providing greater stability when display rack 10 is attached to a conventional gondola or fixed mounting structure.

Figure 6:
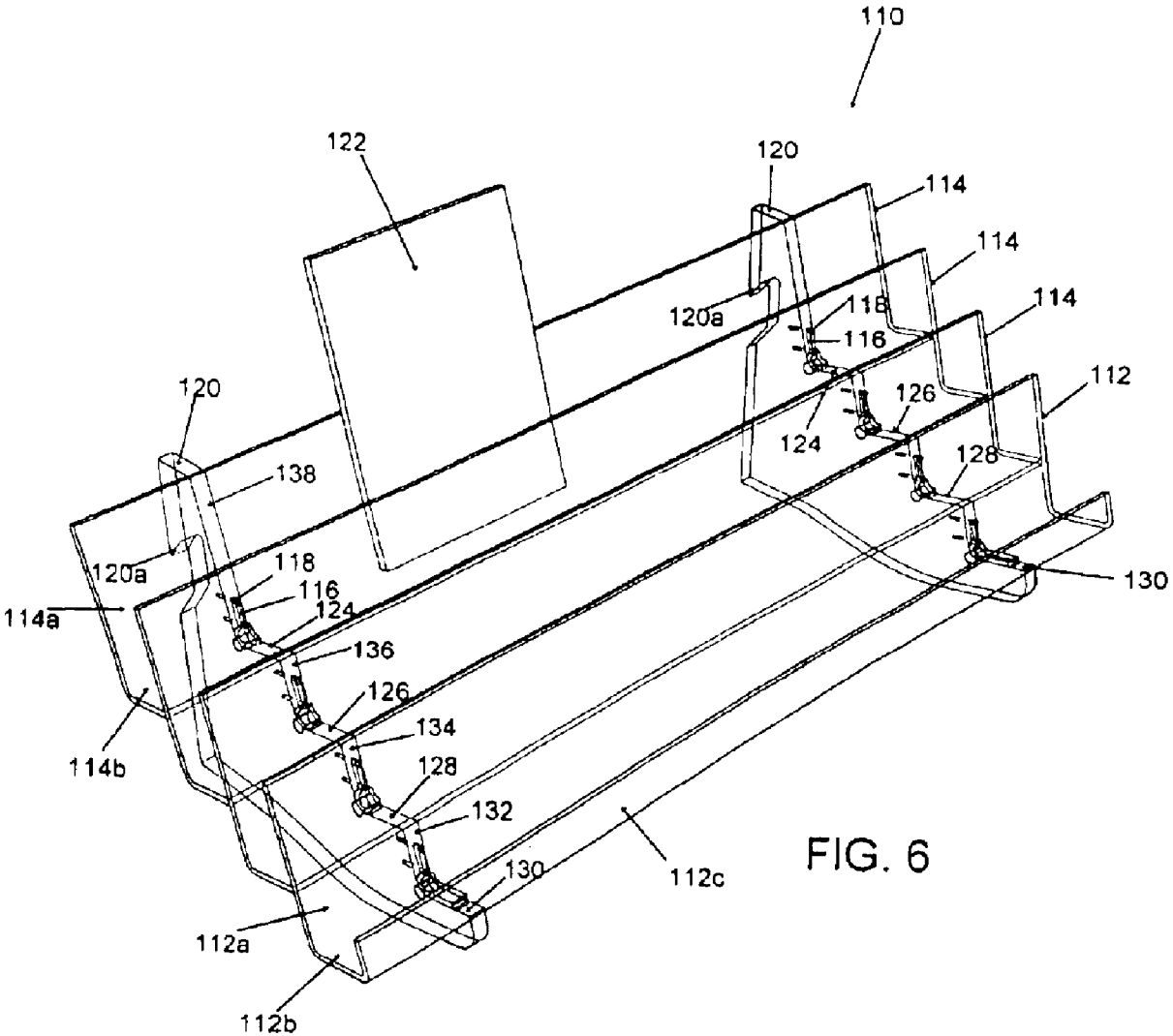
FIG. 6 illustrates an alternative embodiment of the device of the present invention.

FIG. 6 depicts an alternative embodiment 110 of a display rack constructed in accordance with the teachings of the present invention. As shown, display rack 110 has a plurality of elongate channels 112 and 114 spaced in vertical arrangement. In the embodiment shown in FIG. 6, the foremost elongate channel 112 has a generally J-shaped cross-section while each of the other elongate channels 114 have generally L-shaped cross-sections with the rear wall of each of elongate channels 114 except for the rearmost forming a low front wall of each elongate channel 114 immediately behind it. The low front wall of the foremost of elongate channels 114 is formed by the high rear wall of elongate channel 112. Low front wall 112*c* of elongate channel 112 is formed because of the J-shaped cross-section of elongate channel 112. It is understood that the present display rack 110 could be constructed with each of the elongate channels having a generally J-shaped cross-section such as that of elongate channel 112, or with each of the elongate channels having a generally L-shaped cross-section such as that of elongate channel 114.

This alternative embodiment of the display rack has four elongate channels 112 and 114, with the foremost of these being an elongate channel 112 and the others being elongate channels 114. Each of elongate channels 112 and 114 has two vertical slits 116 cut therein. Slits 116 are adapted such that fasteners 118 may extend therethrough and thereby attach elongate channels 112 and 114 to weight transfer segments 120. Thus, when articles such as magazine 122 are placed within the troughs of elongate channels 112 and 114, the weight of the articles is distributed evenly among weight transfer segments 120.

Weight transfer segments 120 are preferably constructed of a unitary piece of acrylic material or other suitable, preferably transparent material. Each weight transfer segment 120 preferably has a plurality of L-shaped cutouts for supporting the attachment of elongate channels 112 and 114 thereupon. The L-shaped cutouts are disposed in a tier arrangement such that each elongate channel 112 or 114 is higher and rearward relative to the one preceding it. Alternative embodiment 110 of the present invention utilizes a four-tiered arrangement for the placement of four elongate channels 112 and 114. The foremost, lowermost L-shaped tier forms a bottom surface 130, a rear wall surface 132, and a plurality of openings (not shown) in rear wall surface 132 adapted for receipt of fasteners 118 therein. The second tier from the foremost tier forms a bottom surface 128, a rear wall surface 134, and a plurality of openings (not shown) in rear wall surface 134 adapted for receipt of fasteners 118 therein. The third tier from the foremost tier forms a bottom surface 126, a rear wall surface 136, and a plurality of openings (not shown) in rear wall surface 136 adapted for receipt of fasteners 118 therein. The rearmost, highest tier forms a bottom surface 124, a rear wall surface 138, and a plurality of openings (not shown) in rear wall surface 138 adapted for receipt of fasteners 118 therein. Weight transfer segments 120 each further include an attachment portion 120*a* for attaching display rack 110 to a conventional gondola or fixed mounting structure (not shown).

This embodiment of a display rack constructed in accordance with the teachings of the present invention is assembled in a manner similar to that of the preferred embodiment disclosed above. Elongate channels 112 and 114 are mounted on weight transfer segment 120 such that slits 116 are aligned with the openings adapted to receive fasteners 118. Fasteners 118 are inserted through slits 116 and into the openings, thereby attaching elongate channels 112 and 114 to weight transfer segment 120. Fasteners 118 may be screws or any other fastener suitable for attaching elongate channels 112 and 114 to weight transfer segment 120. Once attached, elongate channels 112 and 114 are flush against the bottom and rear wall surfaces of L-shaped tiers 124, 126, 128, and 130, and are tilted at a slight upward angle such that retention of any articles displayed on display rack 110 is accomplished by gravity. This alternative embodiment of the present invention 110 utilizes two weight transfer segments 120 for supporting elongate channels 112 and 114. In such an embodiment, the attachment of the second weight transfer segment 120 is substantially identical to the attachment of the first weight transfer segment 120. This arrangement allows the weight of any articles displayed on display rack 110 to be distributed equally among the two weight transfer segments 120, thereby providing greater stability when display rack 110 is attached to a conventional gondola or fixed mounting structure.

The height of the display rack of the present invention may be varied by varying the number of elongate channels 12 and 14 used in the construction of the device and by correspondingly varying the structure of weight transfer segments 20 to accommodate the number of elongate channels 12 and 14.

The length of the display rack of the present invention may also be varied. This may be accomplished by constructing elongate channels 12 and 14 of the desired length and utilizing a number of weight transfer segments 20 appropriate to the length of the elongate channels. Alternatively, a number of elongate channels 12 and 14 may be placed end-to-end such that a desired length is attained. Again, the number of weight transfer segments 20 must be varied accordingly so that the appropriate amount of support and weight distribution is imparted to the structure.

The display rack of the present invention may be constructed of various suitable materials such as acrylic material, plastic, wood, or metal and the like, or any combination of these materials. Though any or all of these materials may be used, it is preferred that the device be constructed entirely of acrylic material to achieve the uniformity of appearance discussed above. It is noted, however, that such uniformity of appearance may be achieved with other suitable materials.

It is understood that the invention is not limited to the specific details described herein, which are given by way of example only, and that various modifications and alterations are possible without departing from the spirit or scope of the invention as defined in the claims.

What is claimed is:

1. A display rack operable to free stand and wall mount comprising:

a generally triangularly shaped unitary weight transfer segment having a generally flat rear and a front and a facing support side having generally L-shaped stair-stepped tiered cut-outs where a highest tier cut-out located adjacent to rear and a lowest tier cut out is located adjacent the front and each cut out forms a bottom support surface and a rear wall support surface, and where said unitary weight transfer segment has a notch in the generally flat rear for hanging purposes and an angled bottom for tilting the channels for retention of articles;

a first generally L-Shaped elongate channel supported by one of the tiered cut-outs where a rear wall of the first L-shaped channel has a height taller than the height of the rear wall support surface of the tiered cut-outs and a bottom wall surface of the first L-Shaped channel having a run with a length substantially the same as the length of a run of the bottom support surface of the tiered cut-outs; and a generally J-Shaped elongate channel supported by the lowest of the tiered cut-outs where a rear wall of the J-shaped channel has a height taller than the height of the rear wall support surface of the tiered cut-outs and a bottom wall surface of the J-Shaped channel having a run with a length and a front wall surface having a height shorter than the height of the rear wall of the J-shaped channel, where the bottom wall surface of the first L-shaped channel abuts, from the rear, against the rear wall of the J-shaped channel at a position below a highest point on the rear wall of the J-channel and where the display rack is operable to freely stand on an underlying surface with a tilt due to the angled bottom of the weight transfer segment and further operable to wall mount by hanging the rack utilizing the notch.

2. The display rack as recited in claim 1, further comprising:

a second generally L-shaped elongate channel supported by one of the tiered cut-outs where a rear wall of the second L-shaped channel has a height taller than the height of the rear wall support surface of the tiered cut-outs and a bottom wall surface of the second L-shaped channel having a run with a length substantially the same as the length of the run of the bottom support surface of the tiered cut-outs, where the second channel is supported on a tier immediately above the tier supporting the first channel and where the bottom wall surface of the second L-shaped channel abuts from the rear against the rear wall of the first L-shaped channel at a position below a highest point on the rear wall of the first L-shaped Channel.

3. The display rack as recited in claim 2, further comprising a plurality of fasteners adapted to fasten the rear wall of the L-shaped channels flush against the rear wall support surfaces of the weight transfer segment.

4. The display rack as recited in claim 2, the L-shaped channels, the J-shaped channel and the weight transfer segment are made of a transparent material that is substantially rigid.

5. The display rack as recited in claim 2, further comprising a second weight transfer segment substantially identical to the generally triangularly shaped unitary weight transfer segment further supporting the L-shaped channels.

6. The display rack as recited in claim 2, where the notch in the rear of the weight transfer segment is a cut out forming a hook adapted to be hung on a conventional gondola structure.

* * * * *